US007018285B2

(12) United States Patent
Enomoto

(10) Patent No.: US 7,018,285 B2
(45) Date of Patent: Mar. 28, 2006

(54) DISC GUIDING DEVICE

(75) Inventor: Minoru Enomoto, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 163 days.

(21) Appl. No.: 10/411,460

(22) Filed: Apr. 10, 2003

(65) Prior Publication Data

US 2003/0227123 A1 Dec. 11, 2003

(30) Foreign Application Priority Data

Apr. 12, 2002 (JP) ..... 2002-111242

(51) Int. Cl.
*G07D 1/00* (2006.01)

(52) U.S. Cl. ..... 453/49; 453/9; 453/33; 453/34; 453/35; 453/39; 453/57; 194/344; 193/DIG. 1

(58) Field of Classification Search ..... 194/334, 194/337, 338, 342–246, 353; 221/267; 453/9, 453/30, 32–35, 39, 40, 49, 50, 57; 379/150–154
See application file for complete search history.

(56) References Cited

U.S. PATENT DOCUMENTS

| | | | | |
|---|---|---|---|---|
| 2,734,680 | A * | 2/1956 | Jones | 232/44 |
| 4,943,258 | A | 7/1990 | Abe | |
| 5,512,016 | A | 4/1996 | Tani | |
| 5,558,197 | A | 9/1996 | Rothschild et al. | |
| 5,876,275 | A | 3/1999 | Rasmussen | |
| 6,080,057 | A * | 6/2000 | Bell et al. | 453/57 |
| 6,176,363 | B1 * | 1/2001 | Suverein et al. | 194/344 |
| 6,786,814 | B1 * | 9/2004 | Chen | 453/33 |

* cited by examiner

*Primary Examiner*—Gene O. Crawford
*Assistant Examiner*—Jeffrey Shapiro

(57) ABSTRACT

A guiding structure for discs is disclosed. The guiding structure includes a hopper that dispenses discs one at a time, a guiding device that guides and aligns the dispensed discs, and a holding device for the discs that is located at the lower section of the guiding passageway. The guiding device may be detachably attached to the hopper.

6 Claims, 4 Drawing Sheets

DISC GUIDING DEVICE

CROSS-REFERENCE TO RELATED APPLICATIONS

This application claims priority to Japanese Patent Application Serial No. 2002-111242, filed Apr. 12, 2002 and entitle A Guiding Device for Discs.

FIELD OF INVENTION

The present invention relates generally to a method and apparatus for dispensing discs such as tokens or coins. More particularly, the invention relates to a disc dispensing apparatus that includes an improved guiding device, for guiding and aligning dispensed discs, which is detachable from a disc storing hopper.

BACKGROUND OF THE INVENTION

Japanese Laid Open Patent No. 9-94319 discloses a hopper for dispensing discs one-by-one and a guiding device for aligning and guiding the dispensed discs. The guiding device extends perpendicular and is fixed at a gaming machine that includes a removable hopper. The removable hopper can be maintained outside of the gaming machine, allowing for easy maintenance. The guiding device includes a preventing device, located at the middle of the guiding device, for holding discs to prevent the discs from falling when the guiding device is separated from the hopper. Any discs that are located under the preventing device fall when the guiding device is separated from the hopper. In this case, the fallen discs scatter within the gaming machine, or the discs are taken away from the guiding device to prevent the disc scattering. Consequently, maintenance and operation of a machine including this guiding device is relatively difficult.

Japanese Utility Model No. 7-49573 discloses another guiding device that includes an opening at a lower section of the device, such that discs fall from the opening when the guiding device is separated from the hopper. The device requires that the guiding device must be full with discs before operation of the device. Thus, preparation of the device, which requires filling the device, is relatively difficult.

For the foregoing reasons, improved devices for dispensing discs are desired.

SUMMARY OF THE INVENTION

While the way in which the present invention addresses the deficiencies and disadvantages of the prior art is described in greater detail hereinbelow, in general, according to various aspects of the present invention, a guiding device that prevents or mitigates the loss of discs from the guiding device when the device is separated from a hopper and that does not require filling the device prior to operation of the device is provided. In accordance with further aspects of the invention, the guiding device is relatively easy to operate.

In accordance with one exemplary embodiment of the invention, a guiding device for discs includes a hopper that dispenses discs one-by-one, a guiding device, which guides the dispensed discs in an aligned manner, and a holding device located at a lower section of a guiding passageway of the guiding device. In accordance with one aspect of this embodiment, the guide is detachably attached to the hopper.

When the hopper is separated from the guiding device, the lower disc in the guiding passageway is held in place by the holding device. Accordingly, the lower disc is stopped by the holding device and is held within the guiding passageway. Thus, the discs in the guiding passageway are prevented from falling. Furthermore, the guiding passageway remains full of discs. As a result, refilling the guide is not needed, because the discs are maintained in the guiding passageway. In accordance with one aspect of this embodiment, the holding device includes a slanting surface, which slants to the guiding passageway and a stopper, which can move in a vertical direction between the guiding passageway and the slanting surface. In this case, the stopper is located at a wedge space, which is formed by the slanting surface and the guiding passageway. During operation, when a disc falls, the stopper goes between the disc and the slanting surface. The stopper is moved toward the guiding passageway by the slanting surface. As a result, the disc is pushed to the structuring part, and it is held. When the discs are lifted, the stopper is also lifted. Therefore, the distance between the slanting surface and the guiding passageway increases. The disc is not pushed to the structuring part. As a result, when the disc is lifted, the stopper does not prevent the movement of the disc. This structure does not require a driving device and is therefore relatively inexpensive.

In accordance with one aspect of the invention, the stopper is a ball. The ball can be formed of metal-plated iron, which is relatively inexpensive and easy to purchase. Accordingly, the stopper is inexpensive. Also, when the ball is lifted, it rotates in various directions, allowing the ball to ware at various surfaces, for even ware of the ball.

In accordance with yet another embodiment of the invention, the holding device includes a releasing device for releasing a disc. In this case, when the discs are taken from the guiding passageway, the holding device releases the discs when the holding device is released by the releasing device. This allows relatively easy removal of the discs from the guiding passageway.

In accordance with a further embodiment of the invention, the holding device includes an opening. In accordance with one aspect of this invention, discs are removed from the guiding passageway by inserting a tool into the opening and pushing the stopper. As the stopper is moved, the holding force on the discs is removed. Therefore, the discs can be easily removed from the guiding passageway using the opening. Furthermore, the opening is easily formed.

BRIEF DESCRIPTION OF THE DRAWINGS

A more complete understanding of the present invention may be derived by referring to the detailed description and claims, considered in connection with the figures, wherein like reference numbers refer to similar elements throughout the figures, and:

FIG. 1(*b*) illustrates a cross-sectional view taken along line B—B in FIG. 1(*a*);

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

The following description is provided to enable a person skilled in the art to make and use the invention and sets forth the best modes contemplated by the inventor of carrying out the invention. Various modifications to the description, however, will remain readily apparent to those skilled in the art, since the general principles of a disc guiding device have been defined herein.

Figure 1:
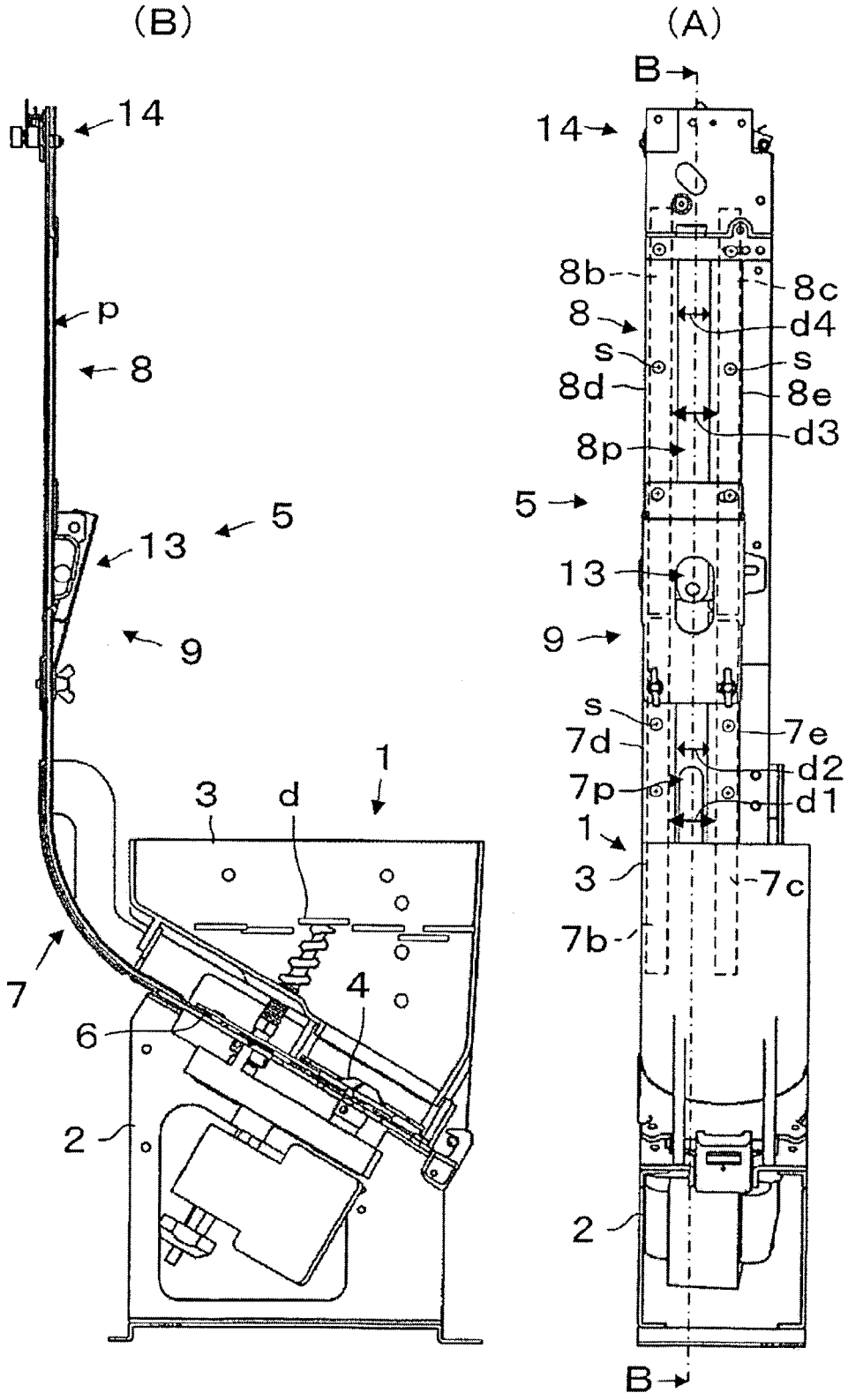
FIG. 1(*a*) illustrates a front view of a hopper and a guiding device in accordance to one embodiment of the invention.

FIG. 1 illustrates a hopper 1, including a frame 2, a bowl 3 (which in the illustrated embodiment is cylindrical in shape) for storing discs d, and a rotating disc 4 for dispensing discs d, and letting rotating disc 6, which is slanted for dispensing discs d to guiding device 5. An exemplary hopper 1 suitable for use with the present invention is disclosed in Japanese Laid Open Patent No. 6-150102.

Disc guiding device 5 includes a bending guiding device 7 and a straight guiding device 8. The lower section of bending guiding device 7 is fixed at frame 2 next to rotating disk 6. Therefore, bending guiding device 7 is fixed to hopper 1.

The upper section of bending guiding device 7 is perpendicular with respect to a portion of frame 2 and is fixed to straight guiding device 8, which is also perpendicular to a portion of frame 2. Straight guiding device is fixed, for example, at a frame of a gaming machine (not illustrated). The lower section of straight guiding device is detachable to the upper section of bending guiding device 7. Accordingly, straight guiding device 8 is a detachable guiding device. In accordance with one embodiment of the invention, bending guiding device 7 is detachably attached to hopper 1.

The structure of bending device 7 and straight guiding device 8 are generally the same. The following specifications are for the case of a 25 cent (U.S.A.) coin. Bending guiding device 7 includes a base 7*a*, which is rectangular, a pair of spacers 7*b*, 7*c*, which are slightly thicker (e.g., about 18 percent thicker) than the thickness of disc d and which are shaped like elongated plates and a pair of supporting plates 7*d*, 7*e* placed in contact with spacers 7*b*, 7*c*. The distance d1 between pair of spacers 7*b*, 7*c* is slightly larger than the diameter of disc d (for example, for a disc having a diameter of about 24.3 mm, the spacers are placed about 25.3 mm apart). The distance d2 between supporting plates 7*d*, 7*e* is smaller than distance d1 (e.g., about 16.3 mm for a d1 of about 25.3 mm). Supporting plates 7*d*, 7*e* and spacers 7*b*, 7*c* are fixed at base 7*a* by screws s.

A guiding passageway 7*p* is enclosed by base 7*a*, spacers 7*b*, 7*c* and supporting plates 7*d*, 7*e*. Spacers 7*b*, 7*c* and supporting plates 7*d*, 7*e* have about the same length (e.g., about 350 mm) and extend upward above base 7*a*.

Straight guiding device 8 include a base 8*a*, which is rectangular, a pair of spacers 8*b*, 8*c*, which are slightly thicker than the thickness of disc d and which are shaped like elongated plates and a pair of supporting plates 8*d* and 8*e*, which are in contact with spacers 8*b*, 8*c*. The distance d3 if pair of spacers 8*b* and 8*c* is the same as d1. The distance d4 between supporting plates 8*d* and 8*e* is the same as d2.

Figure 3:
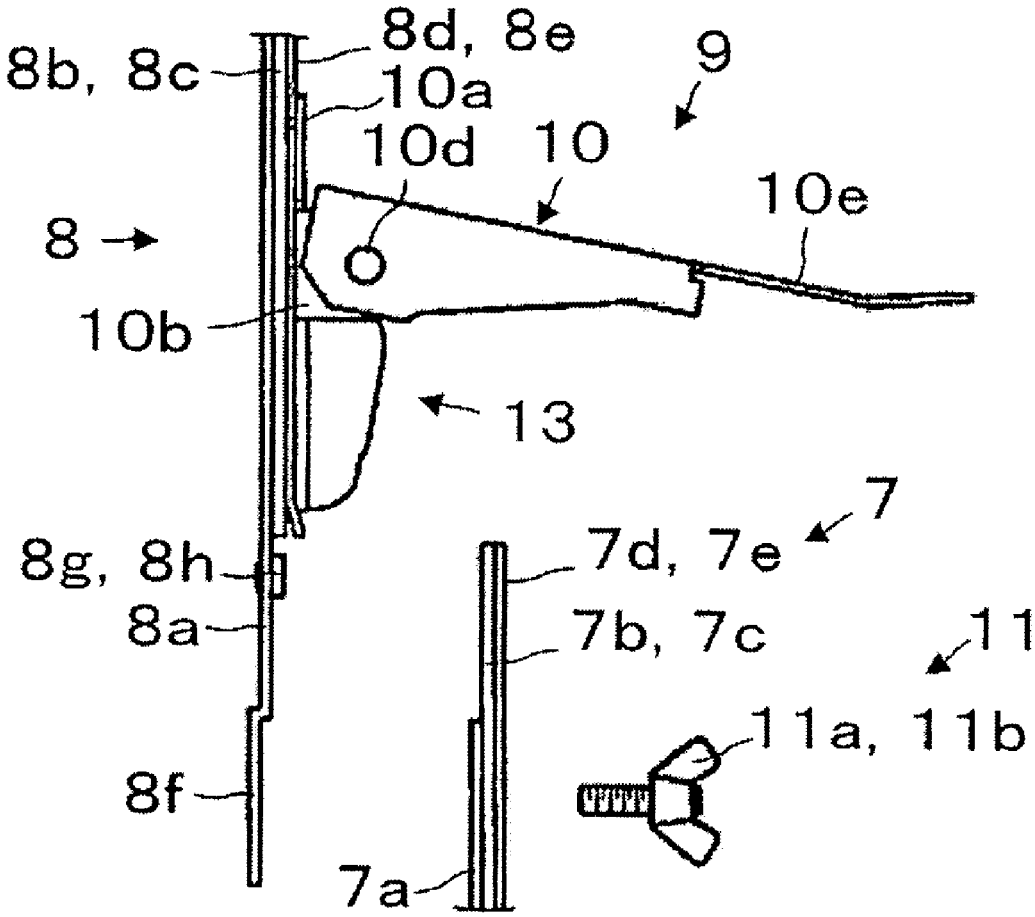
FIG. 3 illustrates a disassembled side view of the guiding device is accordance with the present invention, illustrating the flip-up situation of the supporting plate.
Figure 4:
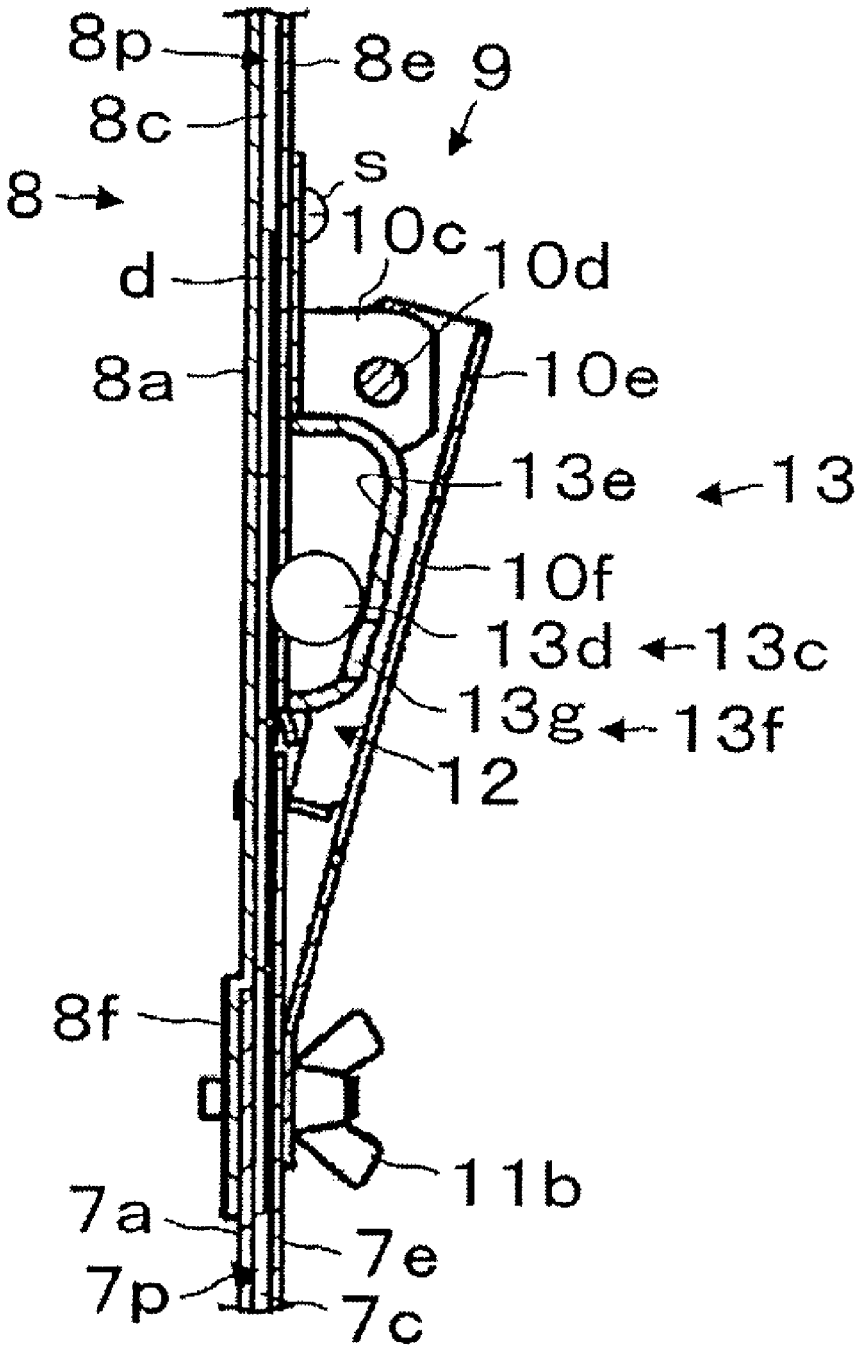
FIG. 4 illustrates a partial sectional-view of a guiding device in accordance with the present invention.

The spacers 8*b*, 8*c* and the supporting plates 8*d*, 8*e* are fixed at a base 8*a* by screws s. A second guiding passageway 8*p* is enclosed by base 8*a*, spacers 8*b*, 8*c*, and supporting plates 8*d*, 8*e*. The lower section of base plate 8*a* extends downwards from supporting plates 8*d*, 8*e*, and extending section 8*f* is crank like in shape as shown in FIGS. 3 and 4.

Registration pins 8*g* and 8*h* are cylindrical and are fixed at base plate 8*a* under spacers 8*b*, 8*c*. Registration holes 7*g*, 7*h* are located at spacers 7*b* and 7*c*, which correspond to registration pins 8*g*, 8*h*. Extending section 8*f* has contact with the rear of base 7*a*, and spacers 7*b*, 7*c* are sandwiched between base 8*a* and supporting plates 7*d*, 7*e*. In this situation, registration pins 8*g*, 8*h* are located in registration holes 7*g*, 7*h*.

Straight guiding device 8 is fixed to an upper portion of bending guiding device 7 by fixing device 9. Fixing device 9 includes supporting device 10 and joining device 11. In the illustrated embodiment, joining device 11 includes wing bolts 11*a* and 11*b*. Wing bolts 11*a* and 11*b* are inserted through portions of spacers 7*b*, 7*c*, supporting plates 7*d*, 7*e*, and supporting plated 10*e*, and screw into extending section 8*f*. In this situation, first guiding passageway 7*p* and second guiding passageway 8*p* are perpendicular and are aligned to form passageway p. In other words, base 8*a* is located over base 7*a*, spacer 8*b* is located over spacer 7*b*, spacer 8*c* is located over spacer 7*c*, supporting plate 8*d* is located over supporting plate 7*d* and supporting plate 8*e* is located over supporting plate 7*e*.

Figure 2:
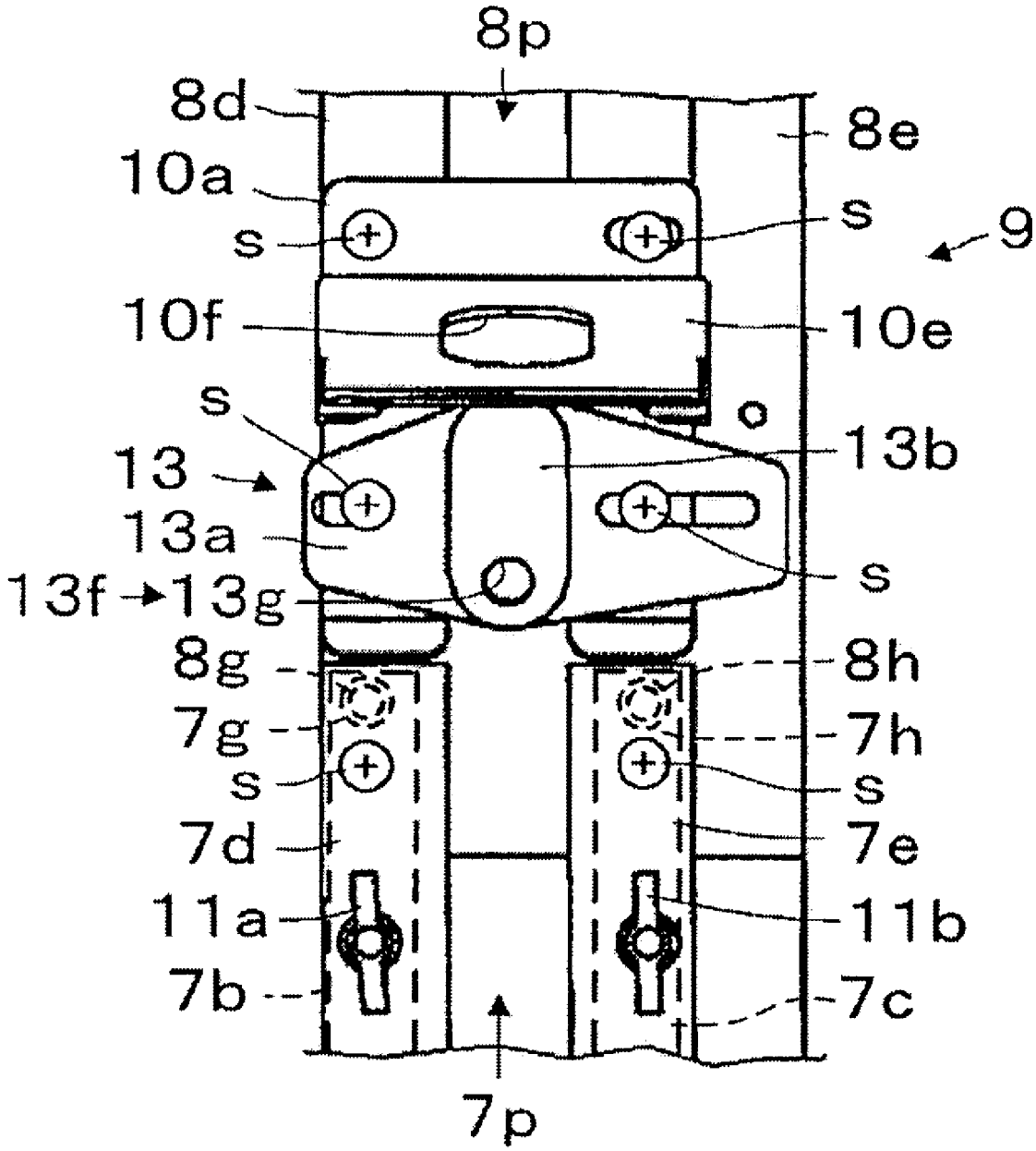
FIG. 2 illustrates an enlarged view of a guiding device, illustrating a flip-up position of a supporting plate.

Supporting device 10 will now be described. Bearings 10*b* and 10*c* extend horizontally and are located at base plate 10*a*, which is fixed between supporting plates 8*d* and 8*e* by screws as shown in FIG. 2. Shaft 10*d* is attached at bearings 10*b* and 10*c*. The upper section of supporting plate 10*e* can pivot on shaft 10. The penetrating holes (not shown) are located at the lower section of supporting plate 10*e*.

Wedge space 12 is enclosed by supporting plates 8*d*, 8*e* and supporting plate 10*e*. The triangle component which is structured by supporting plates 8*d*, 8*e*, bearings 10*b*, 10*c*, supporting plate 10*e*, wing bolts 11*a*, 11*b* improves the joining strength between bending guiding device 7 and straight guiding device 8.

Opening 10*f* is located at the middle of supporting plate 10*e*, such that it is easy to access and to see. Holding device 13 for disc d is located at space 12. Holding device 13 includes guide 13*b* and stopper 13*c*. Guide 13*b* is a half-egg-dome shape and is located opposite second guiding passageway 8*p* which is located at the middle of a stay 13*a*. In the illustrated embodiment, stopper 13*c* is a ball 13*d* formed of iron and metal plating. Stay 13*a* is fixed at supporting plates 8*d* and 8*e* by screws s that are screwed into base 8*a*.

The extending line of guiding slanting surface 13*e* of the inner surface of side 13*b* slants on an acute angle to second guiding passageway 8*p*. When holding device 13 is attached a lower position, the extending line of guiding slanting surface 13*e* crosses an acute angle at first guiding passageway 7*p*. In other words, the distance between guiding slanting surface 13*e* and second guiding passageway 8*p* is narrower at the lower position. Accordingly, when ball 13*d* falls, it moves towards guiding passageway 8*p* by guiding slanting surface 13*e*, and disc d is pushed to base plate 8*a* by ball 13*d* and is thereby prevented from falling out of the guide.

Although illustrated with a stopper comprising a metal-plated iron ball, stopper 13 may be formed of another mechanism that performs the same function. For example, stopper 13*c* can be changed to a wedge shape.

Holding device 13 is structured by slanting surface 13*e* and stopper 13*c*, which falls down by gravity. Accordingly, this mechanism does not require a driving device and as a result is less expensive than other alternative mechanisms. Releasing device 13*f* is located at the lower section of guiding slanting surface 13*e*. Releasing device 13*f* is an opening 13*g* in this embodiment. The shape of opening 13*g* can be circular, rectangular, oval, a slit, or any suitable shape in accordance with this embodiment of the invention. Because tools can be inserted into opening 13*g* and the tools can be used to push ball 13*d*, discs can be easily released using the tool. Releasing device 13*f* can be changed to another mechanism that performs the same function of releasing the stopping or holding device.

When ball 13*d* stops disc d, ball 13*d* is located above the lower edge of opening 13*g*. Accordingly, when ball 13*d* is pushed up using a tool, which is inserted into opening 13*g*, disc d is released from ball 13*d*.

Holding device 13 is desirably attached to the lowest position of second guiding passageway 8*p* for the prevention of undesired release of disc d. However, fixing device 9 is located at the lowest position. Accordingly, in accordance with one embodiment of the invention, holding device 13 is located at the wedge space of fixing device 9, such that holding device 13 can be located at the lowest position of the second passageway 8*p*.

Dispensing device 14 is located at the upper section of straight guiding device 8. An exemplary dispensing device suitable for use with the present invention is disclosed in U.S. Pat. No. 4,592,377.

In operation, rotating disc 4 and letting rotating disc 6 rotate to dispense disc d, one-by-one, to guiding passageway 7*p* of bending guiding device 7. Discs d align with passageway 7*p*. Disc d is pushed up further by a newly dispensed disc d and reaches second guiding passageway 8*p*. The uppermost disc d is dispensed by dispensing device 14 at second guiding passageway 8*p*.

Hopper 1 can be separated from straight guiding device as follows. First, wing bolts 11*a* and 11*b* are loosened and removed. Next, hopper 1 is removed in the direction away from the sheet of paper as illustrated in FIG. 1. As a result, bending device 7 is separated from straight guiding device 8. In this situation, discs d in second guiding passageway 8*p* slightly moves down, as does ball 13*d*, because of slanting surface 13*e*. As a result, disc d does not fall down because disc d is pushed to base plate 8*a* by ball 13*d* and it is held in place. Additional discs d above the held disc are held in place in second guiding passageway 8*p*. Any discs d underneath the held disc are susceptible to falling. The number of discs susceptible to falling with the present invention is mitigated to, for example, 1–2 discs, making operation of the device simplified.

When discs d located in second guiding passageway 8*p* are removed, a tool can be inserted into opening 13*g* and ball 13*d* is pushed up (before the operation, a recovery bowl may be located below straight guiding device 8). In this case, ball 13*d* stops the pushing of disc d to base 8*a*. As a result, discs d in second passageway 8*p* fall into the recovery bowl. When bending guiding device 7 is assembled and unassembled to straight guiding device 8, the taking out and the returning of the operation is in the opposite steps.

Although the present invention is set forth herein in the context of the appended drawing figures, it should be appreciated that the invention is not limited to the specific form shown. For example, while the invention is conveniently described in connection with a gaming machine, the invention is not so limited. Various other modifications, variations, and enhancements in the design and arrangement of the method and system set forth herein, may be made without departing from the spirit and scope of the present invention as set forth in the appended claims.

I claim:

1. An apparatus for guiding and aligning dispensed discs, the apparatus comprising:

a hopper for dispensing discs;

a guiding device, having a guiding passageway, which guides and aligns the discs;

a disc holding device for holding one or more discs in the guiding device located at a lower section of the guiding passageway including a guide housing forming a slanting surface relative to the guiding passageway and opened relative to the guiding passageway opposite the slanting surface and a ball mounted within the guide housing for relative movement along the slanting surface into the guiding passageway for preventing discs from being released at the lower section of the guiding passageway, the slanting surface having an opening smaller than a diameter of the ball at a position adjacent the lowest relative movement of the ball when it engages and prevents a disc from being released at the lower section of the guiding passageway wherein an operator can insert a tool through the opening in the guide housing slanting surface to release the ball from engagement with the disc to enable a release of discs at an entrance to the lower section of the guiding passageway; and a supporting plate pivotally mounted on the guiding device at one end above the guide housing and extending over the guide housing, the supporting plate having a first opening for receiving a joining device below the guide housing for attachment to the guiding device.

2. The guiding device for discs of claim 1, wherein the guiding device comprises a first straight portion and a second curved portion.

3. The guiding device for discs of claim 2, wherein the second portion is releasably coupled to the hopper.

4. The apparatus for guiding and aligning dispensed discs of claim 3, wherein the guiding device is detachably attached to the disc holding device.

5. The guiding device for discs of claim 2 wherein a second opening is provided on the supporting plate at a position to overlap the opening in the closed guide member.

6. In a coin dispenser assembly having bulk coins stored in a hopper and moved from the hopper to a dispensing location, the improvement comprising:

a guiding device, having an elongated guiding passageway extending upward from the hopper;

a coin holding device located at a position on the guiding passageway adjacent the entrance of coins from the hopper, the coin holding device includes a closed guide member and a rotatable ball, the closed guide member aligns the rotatable ball for relative movement into and out of the guiding passageway and includes a supporting slanting surface to enable a gravity bias of the ball into the guiding passageway to prohibit the movement of coins along the passageway in the direction of the hopper;

a releasing device to enable a selective release of coins from an entrance of the passageway adjacent to the hopper, the releasing device being integrally incorporated into the closed guide member as an opening in the closed guide member, wherein the opening is positioned in the supporting slanting surface adjacent the guiding passageway to enable the user to displace the rotatable ball from the guiding passageway to release the coins; and a supporting plate pivotally mounted on the guiding device at one end above the closed guide member and extending over the closed guide member, the supporting plate having a first opening for receiving a joining device below the closed guide member for attachment to the guiding device, and a second opening provided on the supporting plate at a position to overlap the opening in the closed guide member.

* * * * *